US006526621B2

(12) United States Patent
Kaim

(10) Patent No.: US 6,526,621 B2
(45) Date of Patent: Mar. 4, 2003

(54) POSITIONABLE WEB CLEANING BUFF ASSEMBLY

(76) Inventor: Wayne K. Kaim, W10980 Lake View Dr., Lodi, WI (US) 53555

( * ) Notice: Subject to any disclaimer, the term of this patent is extended or adjusted under 35 U.S.C. 154(b) by 105 days.

(21) Appl. No.: 09/780,582

(22) Filed: Feb. 9, 2001

(65) Prior Publication Data

US 2002/0108203 A1 Aug. 15, 2002

(51) Int. Cl.[7] ..... B08B 7/00
(52) U.S. Cl. ..... 15/308; 15/256.5; 15/309.1
(58) Field of Search ..... 15/308, 256.5, 15/309.1

(56) References Cited

U.S. PATENT DOCUMENTS 1,007,666 A * 11/1911 Baldwin ..... 15/308
2,695,758 A * 11/1954 Tollison ..... 15/256.5
2,824,319 A * 2/1958 Nagele ..... 15/308
3,398,022 A * 8/1968 Maust ..... 134/15
4,715,078 A 12/1987 Howard et al.
5,163,369 A 11/1992 Hawitt
5,425,813 A * 6/1995 Ernst et al. ..... 134/15
5,507,917 A * 4/1996 Didier et al. ..... 15/256.5
5,685,043 A * 11/1997 LaManna et al. ..... 15/256.5
6,178,589 B1 1/2001 Kaim

* cited by examiner

*Primary Examiner*—Chris K. Moore
(74) *Attorney, Agent, or Firm*—Lathrop & Clark LLP

(57) ABSTRACT

A positioning frame supports a rotating buff roll within a vacuum plenum at a desired location adjacent a moving web of material. The apparatus has a drive arm with a jackshaft and a support arm each pivoted off bases which may be clamped to a single cross machine direction shaft. The motor drive may also be positioned at a variety of orientations. Three parallel axes of adjustment are defined by the positioning frame granting the installer of the apparatus great latitude in positioning the buff assembly near the web to be cleaned. Two web cleaning apparatuses may be installed on opposite sides of an open span of web, or a first apparatus may be engaged against the web where it turns around a roll, and a second apparatus may be engaged against the web where it turns around a downstream roll.

18 Claims, 5 Drawing Sheets

POSITIONABLE WEB CLEANING BUFF ASSEMBLY

CROSS REFERENCES TO RELATED APPLICATIONS

Not applicable

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to apparatus for cleaning webs of material in general, and in particular to apparatus which is readily positioned on pre-existing machinery.

There are many installations of machinery which treat raw web stock, such as by printing, trimming, folding, etc. in many cases, the stock paper, plastic or other material may come from the place of manufacture with a quantity of dust or particular matter associated therewith. Although of small size, this material can contribute, over time, to a degradation of printing or other treating performance. It has been found that, by positioning a rotating buff in proximity to the moving web, and drawing away the air which passes over the buff through a vacuum hood, marked reduction in contamination of the machinery can be obtained. However, in most cases web cleaning apparatus is not provided as standard equipment by machinery manufacturers. As result, volume to receive retrofitted web cleaning apparatus is not always available where desired within the machinery.

In my previous U.S. Pat. No. 6,178,589, the disclosure of which is incorporated by reference herein, I disclosed a web cleaning apparatus which was readily positionable within the arch of a conventional web printing press. This apparatus permitted opposed web buff cleaning assemblies to be positioned temporarily within the arch above the slot in the printing press floor. This provided one effective approach to utilizing the restricted space available in pre-existing machinery for installation of web cleaning buff assemblies. Nevertheless, there are a wide variety of press and web machinery each with its own particular configuration and arrangement of rolls and web treating equipment. Depending on a particular site's requirements, the size, number, and arrangement of web cleaning buff assemblies may vary.

What is needed is a buff assembly which may be readily positioned on preexisting machinery in a wide variety of positions with minimal modification to the machinery.

SUMMARY OF THE INVENTION

The web cleaning apparatus of this invention has a positioning frame which supports a rotating buff roll within a vacuum plenum at a desired location adjacent a moving web of material. The apparatus has a drive arm with a jackshaft and a support arm each pivoted off bases which may be clamped to a single cross machine direction shaft. The motor drive may also be positioned at a variety of orientations. Three parallel axes of adjustment are defined by the positioning frame granting the installer of the apparatus great latitude in positioning the buff assembly near the web to be cleaned. Two web cleaning apparatuses may be installed on opposite sides of an open span of web, or a first apparatus may be engaged against the web where it turns around a roll, and a second apparatus may be engaged against the web where it turns around a downstream roll.

It is a feature of this invention to provide a web cleaning apparatus which is easily installed on a pre-existing machine having restricted available volume.

It is another feature of this invention to provide a web cleaning apparatus which may be installed in segments without the use of rigging equipment.

It is also a feature of this invention to provide a web cleaning apparatus which is readily adjustable in the field to modify the position of a rotating buff.

It is an additional feature of this invention to provide a web cleaning apparatus which secures readily to a single cross shaft. Further objects, features and advantages of the invention will be apparent from the following detailed description when taken in conjunction with the accompanying drawings.

DESCRIPTION OF THE PREFERRED EMBODIMENTS

Figure 1:
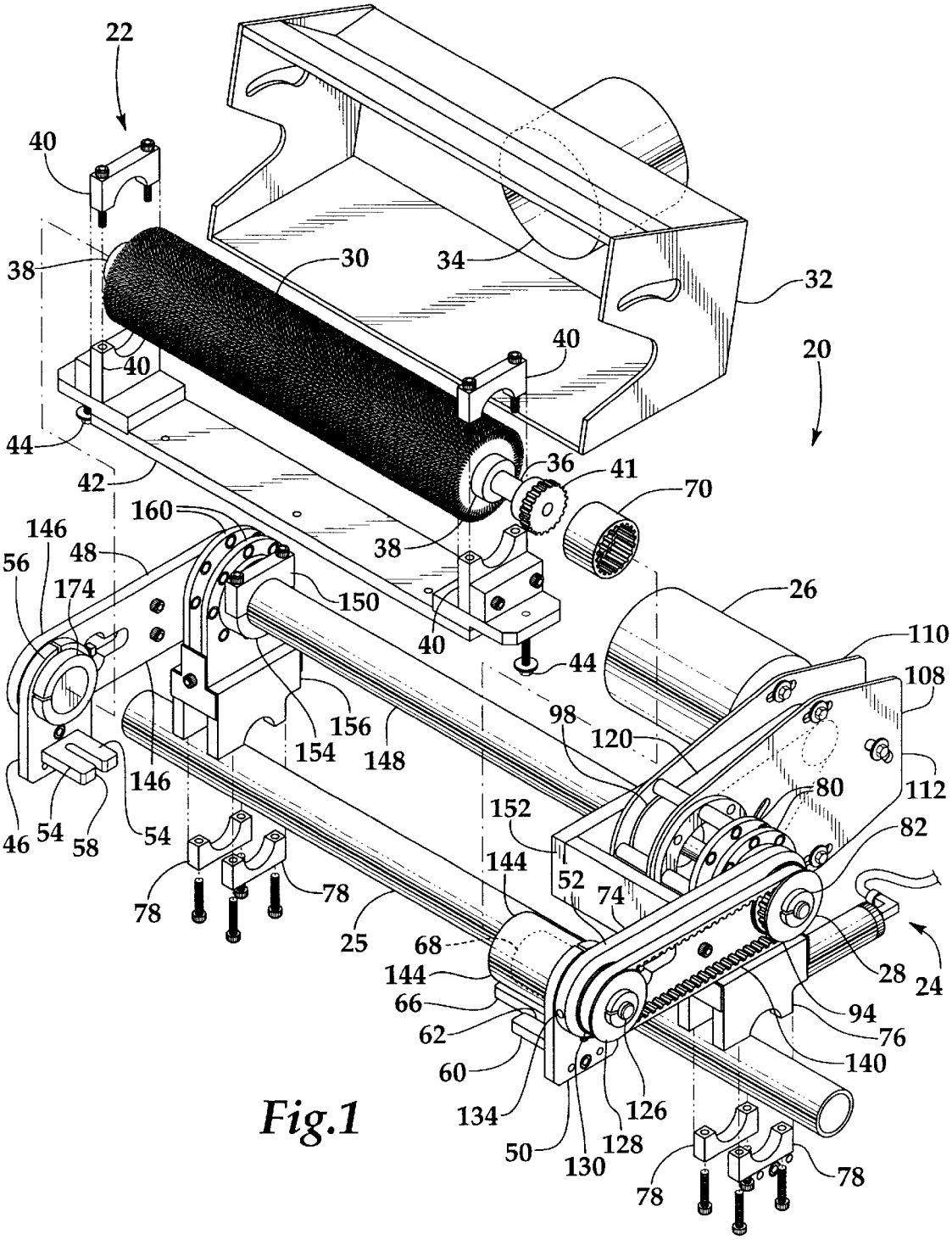
FIG. 1 is an exploded isometric view of the web cleaning apparatus of this invention.

Referring more particularly to FIGS. 1–6, wherein like numbers refer to similar parts, a positionable web cleaning apparatus 20 is shown in FIG. 1. The apparatus 20 supports a buff assembly 22 in proximity to a web for the cleaning of one surface thereof. The buff assembly 22 is supported on a positioning frame 24 which securely supports the buff assembly during operation. As discussed in more detail below, two similar web cleaning apparatus 20 are installed on a pre-existing web processing machine, such as a web offset press used in printing newspapers. Typically, one apparatus 20 is provided for each of the two surfaces of the web to be cleaned. The apparatus 20 supports from a single cross machine direction support shaft 25: the buff assembly, a motor drive 26, and the drivetrain 28 which connects the motor drive to the buff assembly. The positioning frame 24 provides for adjustment of the elements of the frame about three parallel pivot axes in a fashion that accommodates the wide variety of machines to which the apparatus 20 may need to be mounted. Furthermore, the apparatus 20 is readily broken down into smaller components which may be then be easily installed one after the other as sub-assemblies upon the support shaft 25.

The buff assembly 22 has a conventional cleaning buff roll 30 which is received within a sheet metal hood or plenum 32. A conduit, not shown, is connected to a rear opening 34 in the plenum 32 and communicates with a source of vacuum, not shown. The buff roll 30 may be composed of buffing disks, typically cloth material which is frayed to form a soft outer surface which is then worn in against a moving web. To effectively clean the web, the interaction between the rotating buff roll 30 must be uniformly established with the boundary layer of air which attaches to a moving web. This boundary layer may be only a small fraction of an inch thick. In general, the buff roll 30 does not touch the moving web which is being cleaned that is spaced from the web by the boundary layer. Particles dislodged from the web become entrained in the boundary layer which then travels with the buff and is drawn off by the vacuum applied to the rear opening 34 of the plenum 32.

The buff roll 30 is supported on a buff shaft 36 with bearings 38 on each end which are engaged within two-part screw clamps 40. A buff coupling sprocket 41 is secured to one end of the buff shaft 36. The clamps 40 are secured to an attachment cross bar 42 which extends parallel to the buff shaft 36. The attachment cross bar 42 is connected to the plenum 32 and fixes the plenum in the appropriate relation to the buff roll 30. Fastening and positioning screws 44 extend from the attachment cross bar 42 away from the buff roll 30. One screw 44 is located on each end of the attachment cross bar 42 and has about one-half inch of exposed shank for being received within the open slots of a bracket 46 extending from a support arm 48 and on the opposite side, another bracket 50 extending from a drive arm 52.

Figure 3:
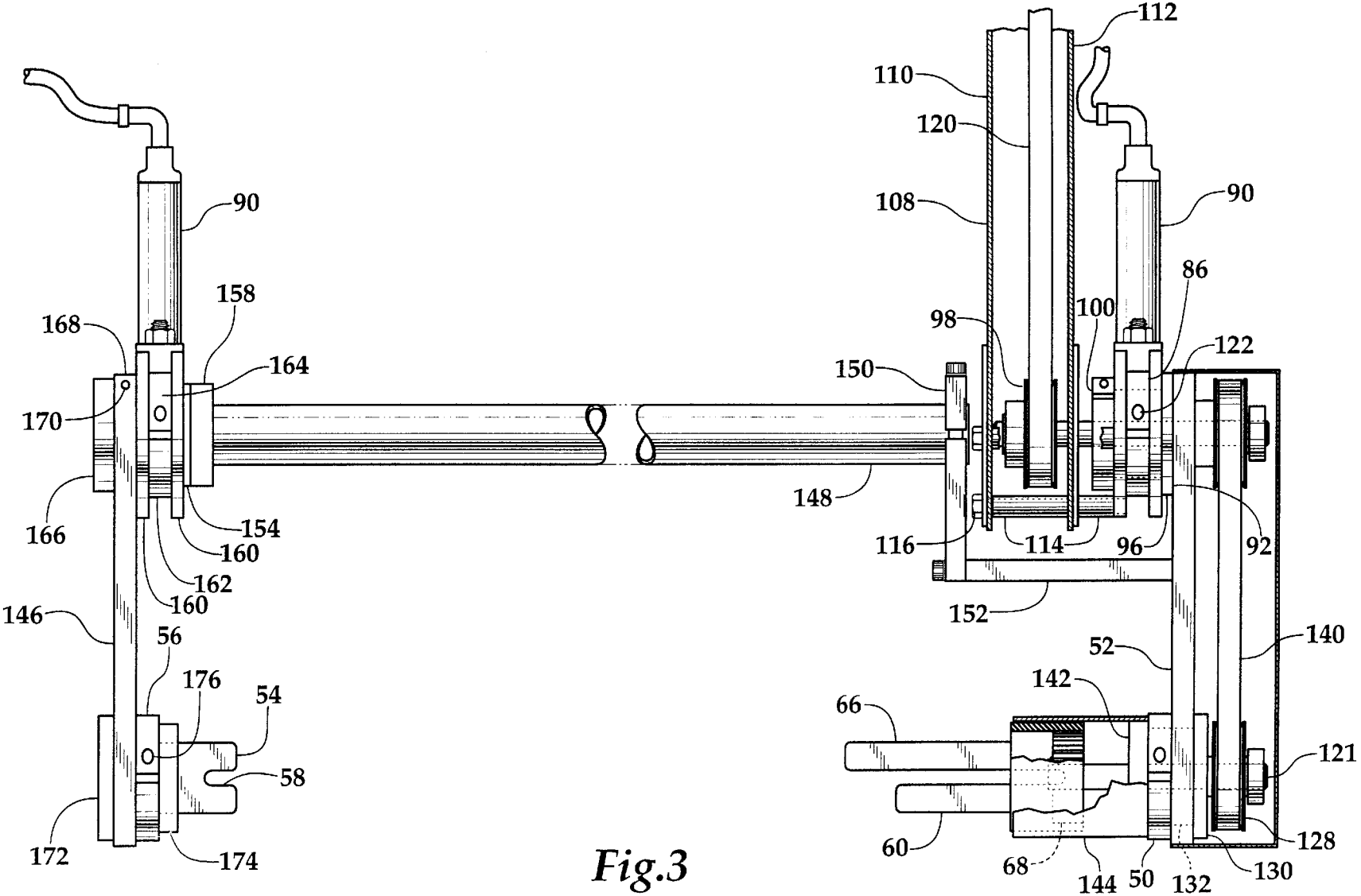
FIG. 3 is a top plan view of the apparatus of FIG. 1, partially broken away in section.

As shown in FIG. 3, the support arm bracket 46 has a platform 54 which extends outwardly from a split ring collar 56. The platform 54 has a short slot 58 which receives one of the buff attachment cross bar positioning screws 44. The drive arm bracket 50 also has a platform 60 which extends toward the support arm bracket platform 54. The drive arm bracket platform 60 has a longer slot 62 which receives the other of the two buff attachment cross bar positioning screws 44. The longer slot 62 is defined between a first finger 64 and a longer second finger 66. The fingers 64, 66 may be attached with screws such that, if optimal for a particular installation, the order of the fingers may be reversed.

To mount the buff assembly 22 to the brackets 46, 50, the attachment cross bar positioning screw 44 farthest from the buff sprocket 41 is slid into the support arm bracket slot 58. With the inserted positioning screw 44 still loose, the weight of the buff assembly may be primarily carried by the support arm bracket 46 while the attachment cross bar is pivoted about an axis defined by the positioning screw 44 to bring the other positioning screw into engagement with the longer second finger 66 of the drive arm bracket 50. Once the sprocket side positioning screw 44 is aligned within the drive arm bracket slot 62, the entire buff assembly 22 is slid towards the drive arm to bring the buff coupling sprocket 41 into engagement with a drive shaft coupling extending from the drive arm 52, and the screws are tightened to secure the attachment cross bar to the brackets. The shaft coupling may be any misalignment tolerant coupling, such as the Series "M" Flexible Shaft Drive Couplings manufactured by Guardian Industries, Inc. of Michigan City, Ind. The coupling employs steel double crowned tooth sprocket hubs as the buff sprocket 41 and the drive sprocket 68, and a nylon internal splined sleeve 70, which connects the two steel hubs, and is tolerant of a certain amount of misalignment between the drive sprocket and the buff sprocket. These couplings are described at http://www.guardiancouplings.com/gd98.htm. and are available from Guardian Industries, Inc. 3201 Ohio Street PO Box 478 Michigan City, Ind. 46361.

The drive sprocket 68 is connected by the drivetrain 28 to the motor drive 26, which may be a conventional electric motor, or may be a pneumatic or hydraulic motor where appropriate. The drive arm assembly 74 is comprised of all the components which are supported on a drive arm base 76 which is releasably and pivotably connected to the cylindrical support shaft 25. As shown in FIG. 1, the drive arm base 76 is secured to the support shaft 25 by two screw clamps 78. By loosening the screw clamps 78, the drive arm base 76, and the entire drive arm assembly may be pivoted about the support shaft 25 which defines a first cross machine direction pivot axis for the apparatus 20.

Figure 2:
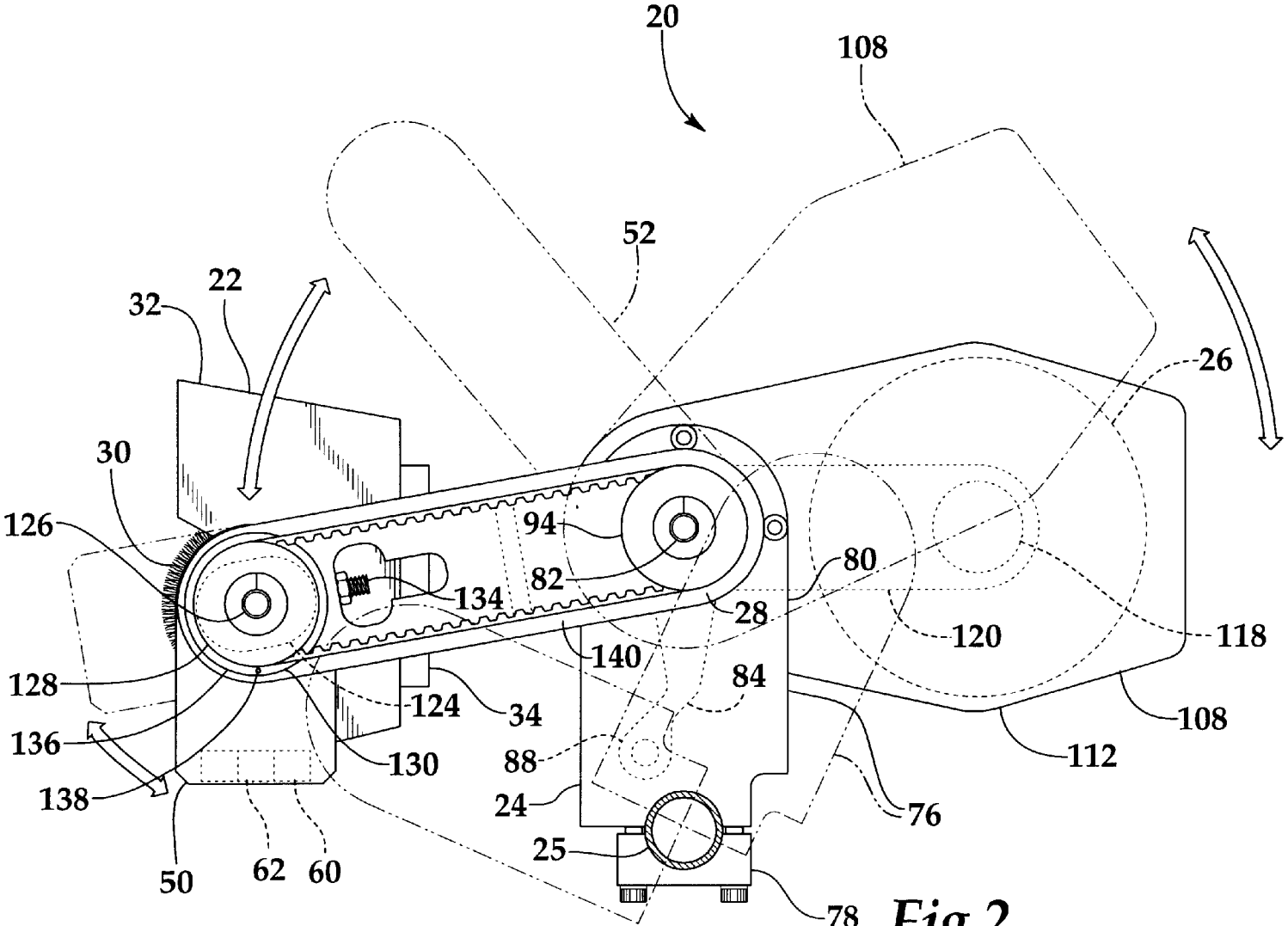
FIG. 2 is a side elevational view of the apparatus of FIG. 1, with alternative positions indicated in phantom view.
Figure 6:
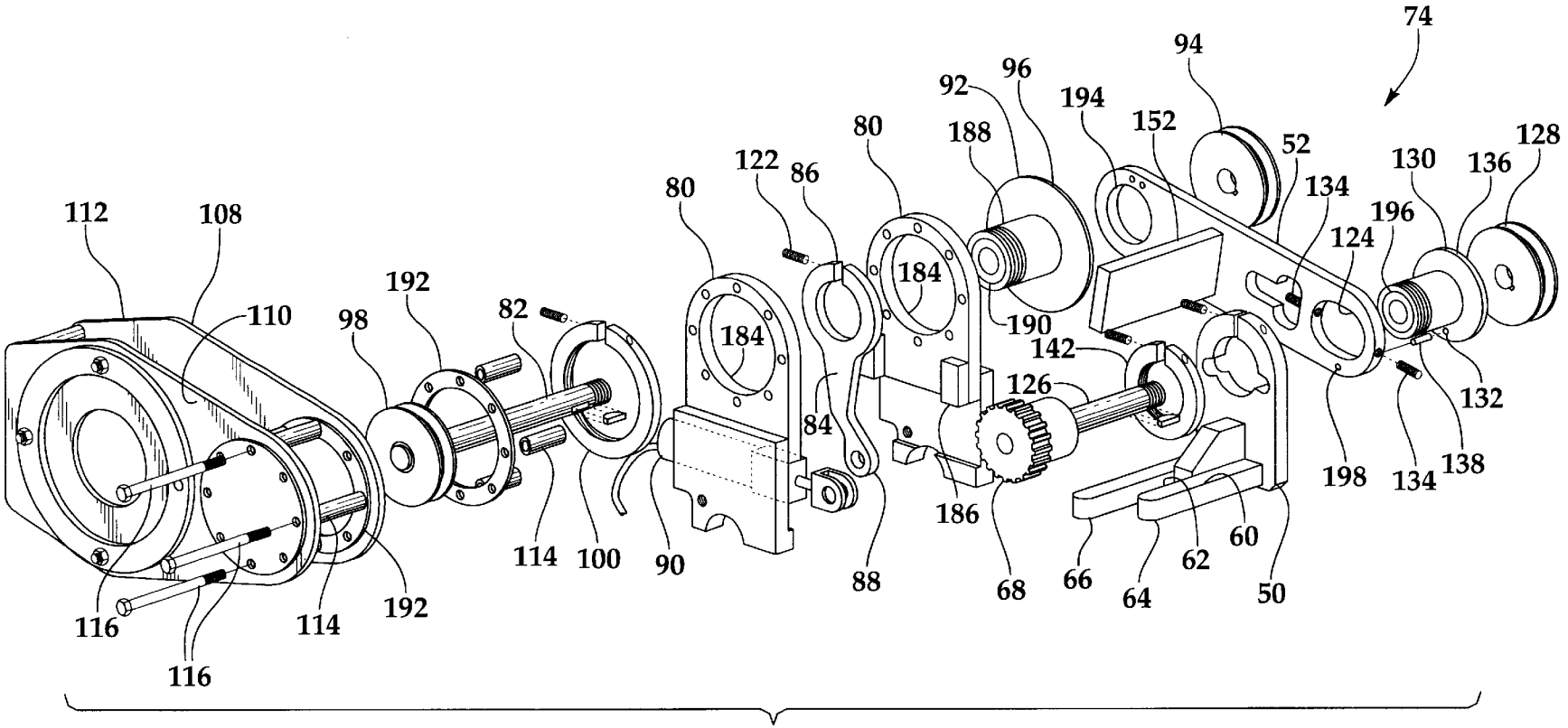
FIG. 6 is an exploded isometric view of the drive arm assembly of the apparatus of FIG. 1.

The drive arm base 76 has two plates 80 which extend upwardly from the screw clamps 78 and which have aligned through holes 184 which provide clearance for the passage therethrough of a first pulley shaft 82. The base plates 80 are connected together with spacer blocks 186 to define a space therebetween which receives a pivot arm 84 as shown in FIG. 2. The pivot arm 84 has a split ring clamp 86 with a downwardly extending link 88 which is pivotably connected to an actuator 90 which is pinned for rotation between the two base plates 80. The pivot arm may be as shown, or may be made symmetrical to permit the direction of the actuator to be reversed if required by a particular installation. The actuator 90 may be a pneumatic, hydraulic, or other linear actuator, and preferably is double acting. The pivot arm split ring clamp 86 is releasably clamped to the tube portion 188 of a flange collar 92 which extends through the through holes in the base plates 80 and which is fixed to the drive arm 52 on the outside of the exterior base plate 80. The flange collar 92 and two sets of bearings form a bearing assembly. As shown in FIG. 6, the flange collar 92 has a pair of coaxial bearings 190 through which the first pulley shaft 82 extends for free rotation. A first pulley 94 is fixed to the first pulley shaft 82 exterior of the flange 96 of the flange collar 92. The first pulley shaft 82 extends inwardly from the first pulley 94 through the flange collar 92, through the two parallel base plates 80 to an interior pulley 98 fixed to the end of the first pulley shaft. The interior end of the tube portion 188 of the flange collar 92 is threaded and receives thereon a threaded clamp collar 100, which, as shown in FIG. 3, is positioned adjacent the interior base plate 80.

As shown in FIG. 2, the motor 26 is secured by fasteners to a motor belt housing 108. The motor belt housing 108 has a motor side plate 110 connected to a far side plate 112 by screw fasteners 116 which extend through spacers 114. As shown in FIG. 3, the motor belt housing 108 is fixed to one of the base plates 80, by the fasteners 116 which extend through several rings 192 having bolt holes and then through spacers 114 to a threaded connection with the base plate 80. The motor belt housing may be provided with a series of curved slots to receive the attachment fasteners to permit the housing to be attached at a variety of angles. The motor side plate 110 and the far side plate 112 are preferably provided with a circular array of fastener holes encircling the first pulley shaft 82 through which multiple fasteners 116 may extend. By selecting the appropriate sets of fastener holes, the orientation of the motor belt housing 108 and the connected motor 26 may be adjusted with respect to the base 76. Thus, the motor belt housing 108, although shown as extending rearwardly from the drive arm base 76, could extend upwardly or at some other angle. The motor belt housing is provided with a guard, not shown, such as a tensioned woven strap which wraps around connected fasteners to encircle and close off access to the interior of the belt housing 108.

The motor 26, as shown in FIG. 2, engages a flexible timing belt 120 which is also looped around the interior pulley 98. Rotation of the motor sprocket 118 drives the belt 120, which in turn rotates the first pulley shaft 82 and the first pulley 94 which projects beyond the drive arm 52. The first pulley shaft 82 defines a second cross machine direction axis of rotation for the apparatus 20. It will be noted that the flange collar 92, which is fixed to the drive arm 52 is coaxial with the first pulley shaft 82 and is mounted to the drive arm base 76 in a fashion to permit rotation of the drive arm about the second axis of rotation. Adjustment of a single adjustment screw 122, shown in FIG. 3, on the pivot arm split ring clamp 86, allows the flange collar 92 and attached drive arm 52 to be either clamped to the pivot arm 84 or be free to rotate with respect to the pivot arm. When clamped to the pivot arm 84, the drive arm 52 is fixed with respect to the base. However, actuation of the actuator 90 will cause the drive arm 52, and the buff assembly 22 which is attached thereto, to pivot about the first pulley shaft 82, permitting the buff assembly to be pivoted out of engagement of the web being cleaned. During installation of the apparatus 20, prior to clamping the flange collar 92 to the pivot arm 84, the drive arm may be rotated to best position the buff assembly 22.

As shown in FIGS. 2 and 6, the drive arm 52 is an aluminum plate which has an opening 194 at one end which receives the first pulley shaft, and an opening 124 at the other end which receives a second pulley shaft 126. A second pulley 128 is secured to the second pulley shaft 126 on the same side of the drive arm 52 as the first pulley 94. A second flange collar 130, similar to the flange collar 92, extends through the opening 124 and has a bearing 196 which receives the second pulley shaft 126 therethrough. The opening 124 is an oblong slot having a height which is slightly greater than the diameter of the tube portion 132 of the second flange collar 130. The width of the opening 124 is longer than its height. Two adjustment screws 134 extend into the opening 124 along the long axis and engage against the tube portion 132 of the second flange collar 130. The flange 136 of the second flange collar 130 has a pin 138 which extends into a pin hole 198 in the drive arm 52 adjacent the opening 124. The second flange collar 130 pivots on the pin 138 when the adjustment screws 134 are adjusted. By this means, the distance between the first pulley 94 and the second pulley 128 is adjusted to apply the desired level of tension to a looped timing belt 140 which extends between the first pulley and the second pulley.

The tube portion 132 of the second flange collar 130 extends through the opening 124 in the drive arm 52 and through the split ring clamp 86 of the drive arm bracket 50. The end of the tube portion 132 is threaded to receive a threaded clamp collar 142 which secures the drive arm bracket 50 against the drive arm 52. The drive sprocket 68 is secured to the second pulley shaft 126 at the end opposite the second pulley 128. A cylindrical tube 144 is screwed to the threaded clamp collar 142 and extends along the second pulley shaft to surround the drive sprocket 68 and projects beyond the drive sprocket. The nylon internal splined sleeve 70 is received within the cylindrical tube 144 and is retained thereby in engagement with the drive sprocket 68.

As shown in FIG. 3, the support arm 48 is spaced opposite the drive arm 52 with the buff assembly 22 engaged between the two arms. The support arm assembly 146 has adjustable pivotable connections similar to those of the drive arm assembly 74 to permit the position of the buff assembly 22 to be adjusted while maintaining the buff roll 30 in parallel relation to the web being cleaned. As an aid to maintaining identical angular positioning of the support arm 48 and the drive arm 52, the two arms may be connected together by a cross shaft 148. The cross shaft 148 is connected to the drive arm 52 by a screw clamp 150 which engages the cylindrical cross shaft with a right angle bracket 152 which projects from a midpoint of the drive arm 52. The right angle bracket 152 allows the cross shaft 148 to be coaxial with the first pulley shaft 82 without engaging the drive base 76 directly. An opening, not shown, may be provided in the cross shaft 148 adjacent the drive arm 52 through which pneumatic hoses for the actuator 90 may be fed to bring all the hoses to a common side of the apparatus 20.

The other end of the cross shaft 148 is received within a flange collar 154 which projects from the support arm base 156. The flange collar 154 has a screw clamp 158 which engages against the cross shaft 148 and secures it to the flange collar. The flange collar 154 has a tube portion which extends through clearance openings in the two spaced base plates 160 of the support arm base 156. As in the drive arm base 76, a clearance is defined between the two support arm base plates 160 into which an actuator extends and is connected to the link of a pivot arm 162 which has an upper split ring clamp 164 which encircles the tube portion of the flange collar 154 and which is selectably secured to the flange collar. Both actuators can then be operated independently to pivot the buff assembly out of engagement with a web, for example for threading the machine, or for other maintenance work, and can then be accurately returned to the original position. The base plates are connected to the support shaft 25 by screw clamps 78.

The tube of the flange collar 154 projects through the two base plates 160 and through a circular opening in the support arm 48. An internally threaded split ring collar 166 engages with the flange collar 154 on the exterior of the support arm 48. Unlike the drive arm 52, the support arm 48 has portions defining a split ring 168 where it attaches to the flange collar 154. By tightening an adjustment screw 170 the support arm is secured to the flange collar 154 at the desired orientation.

The far end of the support arm 48 is identical to the far end of the drive arm 52 in that it has an oblong through hole with two aligned adjustment screws for adjusting the centerline position of the cylindrical shank of a flanged knob 172. The knob 172 projects beyond the support arm 48 and through the split ring collar 56 of the support arm bracket 46, and is secured against axial movement by a threaded split ring collar 174 which engages with the threaded end of the knob 172. Rotation of an adjustment screw 176 in the split ring collar 56 allows the support arm bracket 46 to be adjusted to the desired orientation.

The pivotable relationships between the buff assembly brackets and the arms; between the arms and the bases; between the bases and the support shaft; and between the drive bell housing and the base, provide a wide variety of possibilities for installation of the apparatus 20 within a pre-existing machine. The apparatus 20 may be configured by the installer to suit the exact requirements of the particular job. Without requiring specialized machining or parts, the apparatus 20 is expeditiously adjusted for ready mounting even in tight environments.

To summarize, the apparatus 20 has three parallel cross machine direction axes about which portions of the apparatus are pivotably mounted for fixed positioning at a selected orientation. A first axis is coaxial with the support shaft 25 and permits rotation of the entire apparatus 20, and more particularly the support arm base 156 and the drive arm base 76. A second axis is coaxial with the first pulley shaft 82 and the cross shaft 148 and permits rotation of the arm assemblies with respect to the bases 76, 156. This is also the axis about which the drive belt housing is adjustable to different orientations. In addition, the actuators 90 cause the arms to pivot about this axis to displace the buff assembly into on/off operational positions. A third axis is coaxial with the second pulley shaft 126 and the buff shaft 36 and permits adjustment of the buff assembly 22 including the vacuum plenum 32. This is also the axis about which the buff roll 30 is driven.

In addition, it should be noted that generally the orientation of the parts may be adjusted without the need to completely remove fasteners.

Figure 4:
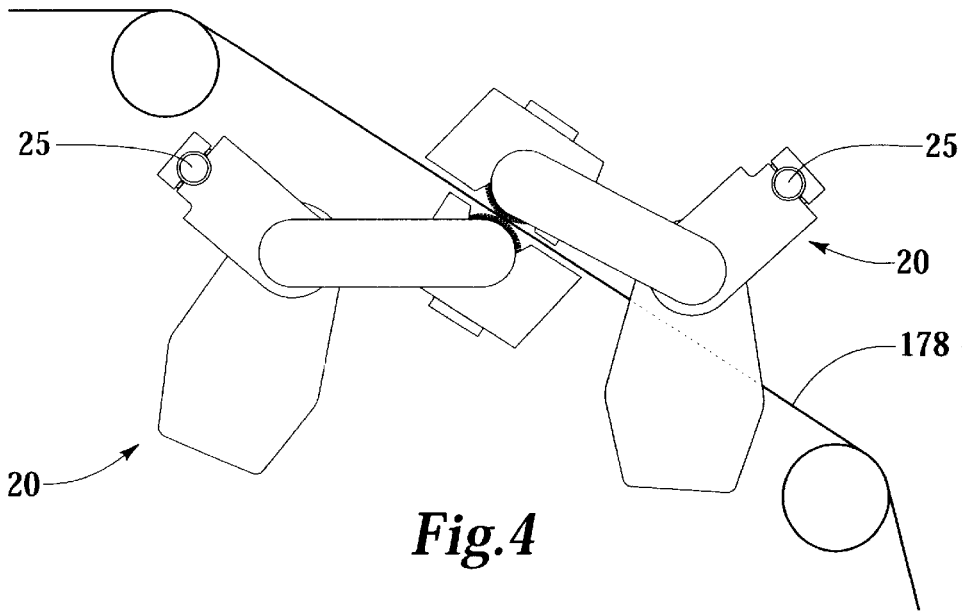
FIG. 4 is a schematic view of an installation of a pair of apparatus of FIG. 1 installed at an open span of web.
Figure 5:
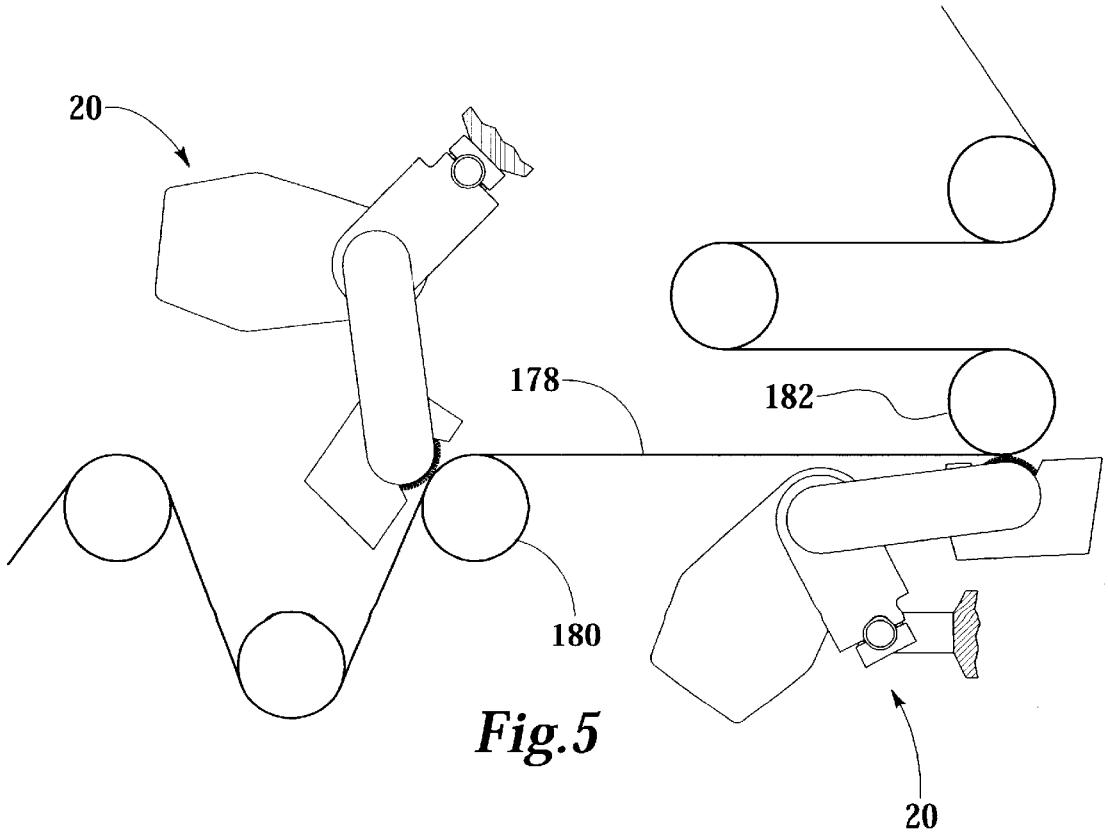
FIG. 5 is a schematic view of an installation of a pair of apparatus of FIG. 1 when installed spaced from one another in engagement with the web as it travels over spaced rolls.

Two examples of installations of the apparatus 20 are illustrated and FIGS. 4 and 5. To clean both surfaces of a traveling web 178, two web cleaning apparatuses 20 must be installed on the web processing machinery. Furthermore, to be effective, the web must be restrained as it passes across the buff roll 30 to prevent fluttering and other unpredictable behavior. A first installation approach, shown in FIG. 4, opposes the two buff assemblies one on either side of the web 178 along an open span of web. All that is required to install each apparatus 20 is a fixed support shaft 25. The support shaft 25 may be clamped to some portion of the machinery frame.

An alternative mounting approach is shown in FIG. 5, where a first web cleaning apparatus 20 engages the web 178 against a first roller 180 to clean a first surface of the web, while the second web cleaning apparatus 20 engages the web against a second roller 182 at a position spaced from the first roller to clean a second surface of the web. It may thus be seen that the web cleaning buff assemblies may be positioned in various orientations by different configurations of the apparatus 20 to take into account the particular volumes available in a particular machine. It should be noted that the schematic views of FIG. 4 and FIG. 5 have omitted the frame and other common obstructions which will be encountered in an actual machinery installation.

It should be noted that a variety of mechanical equivalents may be substituted for the particular pivotable connections and drive linkages disclosed above. For example, although a drivetrain employing timing belts and pulleys has been discussed above, other drivetrains employing gears, friction wheels, fluid drives, or others could be used. Moreover, where the pivotable relations between parts have been disclosed as split rings or screw clamps, other selectably pivotable or rigid connections may be employed. In addition, in certain circumstances the cross tube may be omitted between the drive arm assembly and the support arm assembly. Furthermore, a mirror image apparatus may be constructed from the same parts where it is desirable to mount the drive arm assembly on the opposite side.

It is understood that the invention is not limited to the particular construction and arrangement of parts herein illustrated and described, but embraces such modified forms thereof as come within the scope of the following claims.

I claim:

1. A web cleaning apparatus for attachment to support portions of a web processing machine, the web cleaning apparatus comprising:

a support base pivotably mounted to the support portions for rotation about a first axis, for fixed positioning at a selected orientation with respect to a first angular position defined about the first axis;

a support arm mounted to the support base for positionable rotation about a second axis, for fixed positioning at a selected orientation with respect to a second angular position defined about the second axis;

a drive base pivotably mounted to the support portions for rotation about the first axis, for fixed positioning at a selected orientation with respect to the first angular position about the first axis;

a drive arm pivotably mounted to the drive base for positionable rotation about the second axis, for fixed positioning at a selected orientation with respect to the second angular position about the second axis;

a vacuum plenum mounted between the support arm and the drive arm, and rotatably positionable about a third axis;

a web cleaning buff supported on a buff shaft and rotatable within the vacuum plenum; and a drive motor mounted to the drive base and connected to drive the buff shaft for rotation within the vacuum plenum, wherein the buff and the vacuum plenum are variably positioned with respect to the first axis first angular position to position the buff and the vacuum plenum in proximity to a web to be cleaned.

2. The web cleaning apparatus of claim 1 wherein a web travels through the web processing machine in a machine direction, and a cross machine direction is defined perpendicular to the machine direction, and wherein the first axis and the second axis extend in the cross machine direction, the apparatus further comprising:

a first bracket extending from the drive arm toward the support arm, the first bracket being connected to the drive arm and being adjustable in orientation with respect to the drive arm while remaining connected to the drive arm, the first bracket having a platform which extends toward the support arm, the platform having portions defining a cross machine direction first slot;

a drive shaft extending from the drive arm parallel to the first slot, the drive shaft being rotated by a connection to the drive motor;

a second bracket extending from the support arm toward the drive arm, the second bracket being connected to the support arm and being adjustable in orientation with respect to the support arm while remaining connected to the support arm, the second bracket having a platform which extends toward the drive arm, the second bracket platform having portions defining a first finger, and a second longer finger spaced rearwardly of the first finger to define between the first finger and the second finger a second cross machine direction slot opening toward the first slot;

an attachment cross bar to which the buff shaft is mounted;

a first fastener extending from a first end of the attachment cross bar toward the first bracket platform; and a second fastener extending from a second end of the attachment cross bar toward the second bracket, wherein the second fastener is receivable within the second bracket second slot, such that the buff assembly is pivotable about the second fastener to bring the second fastener against the first bracket second finger, and wherein the buff shaft on the attachment cross bar is then slidable in the cross machine direction to engage the first fastener within the first slot, and bring the buff shaft into engagement with a drive coupler which extends between the buff shaft and the drive shaft.

3. The web cleaning apparatus of claim 1 further comprising;

a pivot arm, pivotably connected at a first end to the drive base about an axis spaced from the second axis, wherein the pivot arm extends from the first end to the drive arm; and an actuator which engages the pivot arm, whereby actuation of the actuator acts to pivot the pivot arm about the second axis, to thereby selectively move the buff from a cleaning position to a spaced position.

4. The web cleaning apparatus of claim 3 wherein the pivot arm has a clamp which selectably secures the pivot arm to the drive arm.

5. The web cleaning apparatus of claim 1 wherein the drive motor is connected to a housing which is connected by fasteners to the drive base, the housing having a circular array of fastener holes through which said fasteners extend, such that the angular orientation of the housing with respect to the base is adjustable by rotating the housing with respect to the base and inserting said fasteners at a desired position.

6. The web cleaning apparatus of claim 1 further comprising:

a first pulley mounted on a first pulley shaft to the drive arm, the first pulley being driven by the drive motor;

a flange collar having a tubular portion, and a radially protruding flange with a pin hole therein;

a second pulley mounted on a second pulley shaft to the drive arm spaced from the first pulley shaft, the second pulley shaft extending rotatably through the flange collar;

portions of the second arm defining an oblong slot which receives the flange collar, wherein the flange of the flange collar is pinned to the drive arm to permit the flange collar to pivot within the oblong slot about the pinned connection;

adjustable screws extending into the oblong slot to engage against the tubular portion of the flange collar; and a belt which extends around the first pulley and the second pulley, wherein rotation of the adjustable screws adjusts the tension applied to the belt.

7. The web cleaning apparatus of claim 1 further comprising:

a first pulley shaft extending along the second axis;

a first pulley mounted to the first pulley shaft;

a second pulley shaft extending along the third axis;

a second pulley mounted to the second pulley shaft; and a belt extending between the first pulley and the second pulley, wherein the first pulley shaft is driven by the drive motor, and the second pulley shaft is connected to drive the buff shaft.

8. The web cleaning apparatus of claim 1 further comprising a cross tube which extends between the drive arm and the support arm approximately coaxial with the second axis, the cross tube being rotatable with the drive arm and the support arm such that both arms may be adjusted in orientation together with respect to the drive base and the support base.

9. A web cleaning apparatus for cleaning of a web traveling in a machine direction, a cross machine direction being defined perpendicular to the machine direction, the apparatus comprising:

a support tube extending in the cross machine direction;

a drive base extending radially outwardly from the support tube and rotatable about the support tube;

a first clamp connected to the drive base to releasably clamp the drive base to the support tube;

a drive arm having a first end which is pivotably connected to the drive base at a position spaced from the support tube, and having a second end spaced from the first end;

a second clamp connected to the drive arm to selectably fix the drive arm to the drive base at a particular orientation with respect to the drive base;

a first bracket rotatably connected to the second end of the drive arm;

a third clamp connected to the first bracket to selectably fix the first bracket to the drive arm at a particular orientation with respect to the drive arm;

a rotating buff assembly having a buff mounted to a buff shaft within a vacuum plenum, wherein the rotating buff assembly is releasably affixed to the first bracket; and a drive motor mounted to the drive base to drive the buff shaft.

10. The web cleaning apparatus of claim 9 further comprising:

a first bracket extending from the drive arm toward the support arm, the first bracket being connected to the drive arm and being adjustable in orientation with respect to the drive arm while remaining connected to the drive arm, the first bracket having a platform which extends toward the support arm, the platform having portions defining a cross machine direction first slot;

a drive shaft extending from the drive arm parallel to the first slot, the drive shaft being rotated by a connection to the drive motor;

a second bracket extending from the support arm toward the drive arm, the second bracket being connected to the support arm and being adjustable in orientation with respect to the support arm while remaining connected to the support arm, the second bracket having a platform which extends toward the drive arm, the second bracket platform having portions defining a first finger, and a second longer finger spaced rearwardly of the first finger to define between the first finger and the second finger a second cross machine direction slot opening toward the first slot;

an attachment cross bar to which the buff shaft is mounted;

a first fastener extending from a first end of the attachment cross bar toward the first bracket platform; and a second fastener extending from a second end of the attachment cross bar toward the second bracket, wherein the second fastener is receivable within the second bracket second slot, such that the buff assembly is pivotable about the second fastener to bring the second fastener against the first bracket second finger, and wherein the buff shaft on the attachment cross bar is then slidable in the cross machine direction to engage the first fastener within the first slot, and bring the buff shaft into engagement with a drive coupler which extends between the buff shaft and the drive shaft.

11. The web cleaning apparatus of claim 9 further comprising;

a pivot arm, pivotably connected at a first end to the drive base about an axis spaced from the second axis, wherein the pivot arm extends from the first end to the drive arm; and an actuator which engages the pivot arm, whereby actuation of the actuator acts to pivot the pivot arm about the second axis, to thereby selectively move the buff from a cleaning position to a spaced position.

12. The web cleaning apparatus of claim 11 wherein the pivot arm has a clamp which selectably secures the pivot arm to the drive arm.

13. The web cleaning apparatus of claim 9 wherein the drive motor is connected to a housing which is connected by fasteners to the drive base, the housing having a circular array of fastener holes through which said fasteners extend, such that the angular orientation of the housing with respect to the base is adjustable by rotating the housing with respect to the base and inserting said fasteners at a desired position.

14. The web cleaning apparatus of claim 9 further comprising:

a first pulley mounted on a first pulley shaft to the drive arm, the first pulley being driven by the drive motor;

a flange collar having a tubular portion, and a radially protruding flange with a pin hole therein;

a second pulley mounted on a second pulley shaft to the drive arm spaced from the first pulley shaft, the second pulley shaft extending rotatably through the flange collar;

portions of the second arm defining an oblong slot which receives the flange collar, wherein the flange of the flange collar is pinned to the drive arm to permit the flange collar to pivot within the oblong slot about the pinned connection;

adjustable screws extending into the oblong slot to engage against the tubular portion of the flange collar; and a belt which extends around the first pulley and the second pulley, wherein rotation of the adjustable screws adjusts the tension applied to the belt.

15. The web cleaning apparatus of claim 9 further comprising:

a first pulley shaft extending along the second axis;

a first pulley mounted to the first pulley shaft;

a second pulley shaft extending along the third axis;

a second pulley mounted to the second pulley shaft; and a belt extending between the first pulley and the second pulley, wherein the first pulley shaft is driven by the drive motor, and the second pulley shaft is connected to drive the buff shaft.

16. The web cleaning apparatus of claim 9 further comprising a cross tube which extends between the drive arm and the support arm approximately coaxial with the second axis, the cross tube being rotatable with the drive arm and the support arm such that both arms may be adjusted in orientation together with respect to the drive base and the support base.

17. A web cleaning apparatus comprising:

a first base for connection to a fixed location on a piece of machinery;

a second base for connection to a fixed location on the piece of machinery at a location spaced in a first direction from the first base;

a first arm connected to the first base, the first arm being adjustable in its orientation with respect to the first base while remaining connected to the first base;

a second arm connected to the second base, the second arm being adjustable in its orientation with respect to the second base while remaining connected to the second base;

a drive motor connected to the first arm;

a first bracket extending from the first arm toward the second arm, the first bracket being connected to the first arm and being adjustable in orientation with respect to the first arm while remaining connected to the first arm, the first bracket having a platform which extends toward the second arm, the platform having portions defining a first slot which extends in the first direction;

a drive shaft extending from the first arm parallel to the first slot;

a drive train connecting the drive motor to the drive shaft;

a second bracket extending from the second arm toward the first arm, the second bracket being connected to the second arm and being adjustable in orientation with respect to the second arm while remaining connected to the second arm, the second bracket having a platform which extends toward the first arm, the second bracket platform having portions defining a first finger, and a second longer finger spaced in a direction perpendicular to the first direction from the first finger to define between the first finger and the second finger a second first direction slot opening toward the first slot;

a buff assembly having a rotatable buff roll with a buff shaft extending therefrom, and a vacuum plenum which receives portions of the buff roll, the buff assembly being mounted to an attachment cross bar which extends in the first direction;

a first fastener extending from a first end of the attachment cross bar toward the first bracket platform; and a second fastener extending from a second end of the attachment cross bar toward the second bracket, wherein the second fastener is receivable within the second bracket second slot, such that the buff assembly is pivotable about the second fastener to bring the second fastener against the first bracket second finger, and wherein the buff assembly is then slidable in the first direction to engage the first fastener within the first slot, and bring the buff assembly shaft into engagement with a drive coupler which extends between the buff shaft and the drive shaft.

18. A web processing machine with web cleaning features comprising:

a frame;

a first roll mounted to the frame;

a second roll mounted to the frame;

a web extending from the first roll to the second roll, such that a first side of the web faces outwardly as the web travels over the first roll, and a second side of the web faces outwardly as the web travels over the second roll, the web advancing in a machine direction from the first roll to the second roll, which is positioned downstream of the first roll;

a first cross shaft fixed with respect to the frame and extending in a cross machine direction perpendicular to the machine direction;

a first web cleaning apparatus mounted to the first cross shaft;

a second cross shaft fixed with respect to the frame and extending in the cross machine direction and positioned downstream of the first cross shaft; and a second web cleaning apparatus mounted to the second cross shaft, wherein both the first web cleaning apparatus and the second web cleaning apparatus have a base clamped to one of the first cross shaft and the second cross shaft, and a drive arm adjustably pivotably attached to the base, and a drive arm bracket adjustably pivotably connected to the drive arm, and a rotatable buff mounted to the drive arm bracket, and a motor positioned remotely from the bracket, but in driving engagement with the buff for rotation thereof, wherein the first web cleaning apparatus is configured to position its rotatable buff adjacent the first roll to clean the first side of the web, and the second rotatable buff is configured to position its rotatable buff adjacent the second roll to clean the second side of the web.

* * * * *